United States Patent [19]

Unger

[11] Patent Number: 4,886,273

[45] Date of Patent: Dec. 12, 1989

[54] TOY AND PUZZLE WITH REVERSIBLE BREAKABILITY

[76] Inventor: Vicki Unger, 4141 Reinhardt Dr., Oakland, Calif. 94619

[21] Appl. No.: 252,694

[22] Filed: Oct. 3, 1988

[51] Int. Cl.[4] ..... A63F 9/12; A63B 43/00; A63H 33/10

[52] U.S. Cl. ..... 273/157 R; 273/1 M; 273/58 R; 273/428; 446/92; 446/419

[58] Field of Search ..... 273/153 S, 157 R, 1 M, 273/58 R, 428; 446/92, 419

[56] References Cited

U.S. PATENT DOCUMENTS

| | | | |
|---|---|---|---|
| 1,235,771 | 8/1917 | Dettra . | |
| 1,282,358 | 10/1918 | Arden . | |
| 1,288,814 | 12/1918 | Blackshear . | |
| 2,052,841 | 9/1936 | O'Donnell . | |
| 2,344,402 | 3/1944 | Frady . | |
| 2,385,724 | 9/1945 | Olson . | |
| 2,465,971 | 3/1949 | Leblang . | |
| 2,570,625 | 10/1951 | Zimmerman et al. | 273/157 R X |
| 2,723,124 | 11/1955 | Martin . | |
| 2,803,920 | 8/1957 | Salosky . | |
| 2,996,833 | 8/1961 | Giuliano . | |
| 3,012,367 | 12/1961 | Neumann . | |
| 3,029,077 | 4/1962 | Benkoe . | |
| 3,117,384 | 1/1964 | Billis | 273/58 R X |
| 3,139,697 | 7/1964 | Mier . | |
| 3,254,440 | 6/1966 | Duggar | 446/92 |
| 3,375,604 | 3/1968 | Alonso . | |
| 3,655,201 | 4/1972 | Nichols | 273/153 S X |
| 3,687,452 | 8/1972 | Thompson . | |
| 4,118,888 | 10/1978 | Ogawa . | |
| 4,193,597 | 3/1980 | Ogawa . | |
| 4,238,905 | 12/1980 | MacGraw | 273/157 R X |
| 4,258,479 | 3/1981 | Roane | 273/157 R X |

FOREIGN PATENT DOCUMENTS

| | | | |
|---|---|---|---|
| 51576 | 5/1982 | European Pat. Off. | 273/1 M |
| 2346555 | 3/1975 | Fed. Rep. of Germany | 273/157 R |

*Primary Examiner*—Anton O. Oechsle
*Attorney, Agent, or Firm*—Irell & Manella

[57] ABSTRACT

A combination breakable toy and puzzle. A ball comprises eight identical wedge-shaped elements, formed of high-impact plastic with hollow interiors. Within the interiors of the individual elements, near the vertices thereof, magnets are mounted for interacting with magnets mounted on the interiors of other wedges, such that the ball may be magnetically assembled by matching opposite polarities of the magnets. The ball may be pried apart, or may be broken apart without structural damage by throwing it against a wall or the floor, and may then be reassembled. The ball may be used as a puzzle, challenging a child to assemble it in the proper fashion. Plus and minus signs may be provided on the faces of the wedge-shaped elements to assist in this task. Other configurations are possible, such as cubes, pyramids and baby rattles.

8 Claims, 3 Drawing Sheets

TOY AND PUZZLE WITH REVERSIBLE BREAKABILITY

BACKGROUND OF THE INVENTION

The present invention is directed to a toy which is assembled by means of magnets mounted within individual pieces of the toy, which may be broken apart and reassembled without damage to the toy.

Certain toys allow for break-up and reassembly, such as those described in U.S. Pat. Nos. 2,996,833, 2,803,920, and 3,687,452. Some such devices are held together by mechanical means such as hooks and springs, and some have portions which are mounted by magnetic means. However, earlier devices do not show toys which are assembled entirely by use of magnets in addition to being breakable upon impact, which may be reassembled. Nor do such earlier designs show toys which also serve as puzzles for children to assemble.

SUMMARY OF THE INVENTION

The present invention comprises a sphere made up of eight identical sedge-shaped elements. Each element is formed from four pieces of preformed high-impact plastic, three pieces being flat and the other being arcuate. A magnet is mounted in a predetermined position on each of the flat pieces, and each wedge is assembled by means of an adhesive along the edges of the individual pieces where they adjoin other pieces. Plus and minus signs may be imprinted on the faces of the wedges to reflect the polarity of the magnets beneath the faces. When the ball is assembled, it may be broken apart by an impact, and reassembled. The strength of the materials for the ball and of the magnets, and the placement of the magnets, are chosen such that the impact necessary to break the ball apart will not cause structural damage thereto. In an alternative embodiment, the toy is in a cube shape, which comprises eight individual cubes formed in a manner similar to the individual wedge-shaped elements of the ball. In another alternative embodiment, the invention comprises a pyramid comprised of four individual smaller pyramids, again constructed in a similar fashion. Yet another embodiment comprises a baby rattle longitudinally divided. Each of the embodiments acts as both a reversibly breakably toy and as a child's puzzle

DETAILED DESCRIPTION OF THE PREFERRED EMBODIMENTS

Figure 1:
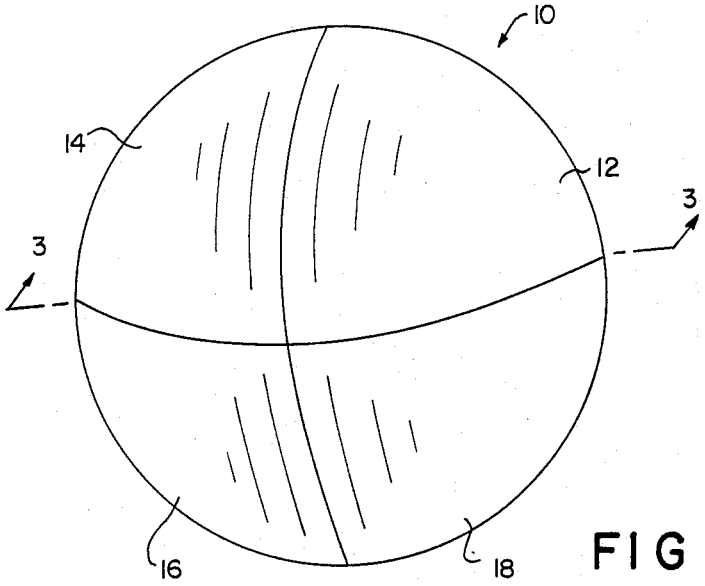
FIG. 1 is a view of the invention in assembled form.
Figure 4:
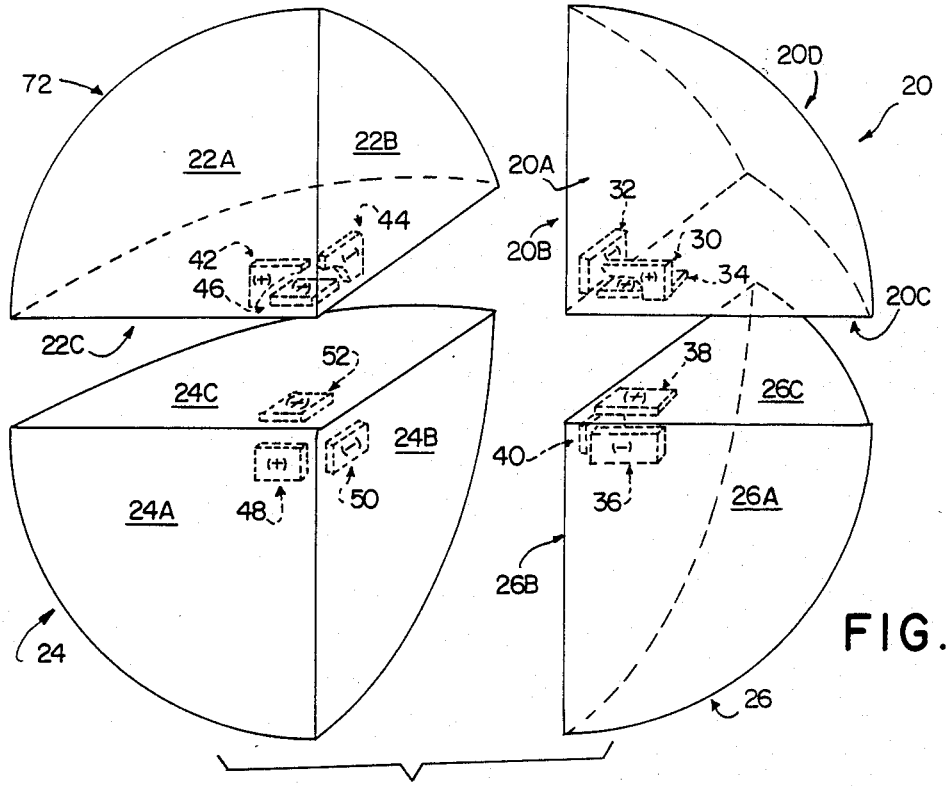
FIG. 4 is an exploded perspective view of FIG. 3.
Figure 3:
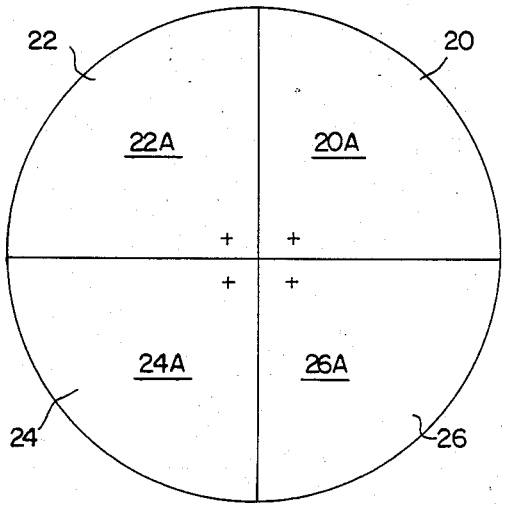
FIG. 3 is a view taken along line 3—3 of FIG. 1.

As shown in FIG. 1, the toy of the present invention preferably comprises a sphere or ball 10 comprising a plurality of individual elements 12, 14, 16 and 18, and (as illustrated in FIGS. 3 and 4) elements 20, 22, 24 and 26.

As shown most clearly in FIG. 4, each of the individual elements of the ball 10 is preferably identical in shape to each of the other elements, and in this embodiment there are eight such elements. The elements 12 and 26 may be formed from plastic, metal, or other materials able to withstand impact.

The following description relative to element 20 will in general terms apply to each of the other elements. Element 20 is preferably formed from a hard plastic, and includes three flat faces 20A, 20B and 20C, and a curved face 20D. Thus, element 20 comprises one-eighth of the ball 10. Element 20 is hollow inside, and on the interior of each face 20A–20C is mounted a magnet, such as magnets 30, 32 and 34, respectively.

Element 26 is of similar structure to element 20, and includes a magnet 36 mounted on the interior face 26A, a magnet 38 mounted on the interior of face 26C, and a magnet 40 mounted on the interior of face 26B. Similarly, element 22 includes a magnet 42 mounted on the interior of face 22A, a magnet 44 mounted on the interior of face 22B, and a magnet 46 mounted on the interior of face 22C. It will be noted that magnets 30, 42 and 44 are shown in partially cut-away fashion for clarity.

Likewise, element 24 includes a magnet 48 mounted on the interior of face 24A, a magnet 50 mounted on the interior of face 24B, and a magnet 52 mounted on the interior of face 24C.

Each of the elements 20, 22, 24 and 26 may be formed by first manufacturing the individual faces (such as flat faces 20A–20C and arcuate face 20D) from thin, hard plastic. The thickness of the plastic or other material is best determined by ensuring that the elements 20–26 will not rupture upon normal impact (such as the impact due to an average child throwing the ball against a wall), but keeping the plastic thin enough so that the magnets will maintain the sphere in shape.

The magnets 30, 32 and 34 are mounted on the faces 20A, 20B and 20C, respectively, such as by an adhesive. Alternatively, the magnets could be pressed into the plastic while it is still in a semi-liquid state, such that when the plastic dries or cures the magnets are maintained in a fixed position. Then, the faces 20A–20D are assembled, such as by an adhesive along their adjoining edges. This process is carried for each of the eight elements 12–26 of the ball 10.

Each magnet such as magnets 30–52 includes a positive pole and a negative pole. These magnets are oriented such that, upon assembly of the ball 10, each magnet will present a pole opposite in sign to the pole of the magnet on the opposing face, i.e. the adjacent face to which it is parallel. Thus, in FIG. 4, faces 20B and 22B are adjacent and parallel, and magnets 32 and 44 are therefore positioned with the negative pole of each magnet to the right in the perspective shown. The positive pole of magnet 32 is therefore presented to the negative pole of magnet 44, with the result that, when faces 20B and 22B are brought relatively near, they will be magnetically fastened together by the magnets 32 and 44. Similarly, the negative pole of magnet 34 on face 20C of element 20 is presented to the positive pole of magnet 38 on face 26C of element 26, such that elements 20 and 26 will be magnetically fastened when faces 20C and 26C are brought together It will be seen by inspection of the other magnets depicted in FIG. 4 that the polarity of each is configured to allow complete assembly of the hemispherical portion of the ball 10 which is depicted in FIGS. 3 and 4. The elements 12–18 are assembled in a similar fashion, and the two halves of the ball 10 are then fastened to one another. It will be appreciated that element 12 includes a magnet (not separately shown) which presents a negative pole to magnet 30 on face 20A of element 20, and similar magnets mounted on parallel faces of elements 14, 16 and 18 present negative poles to magnets 42, 48 and 36, respectively.

Figure 2:
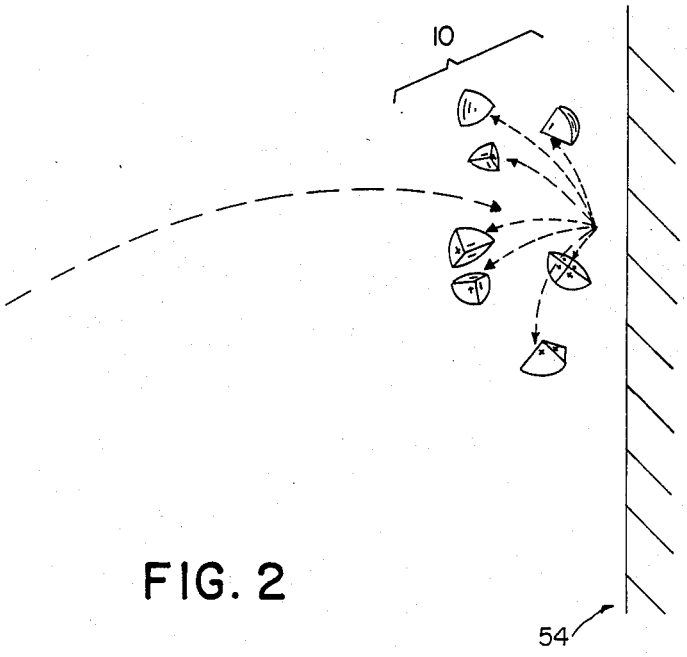
FIG. 2 is an action diagram showing the breakability of the invention.

In order to assemble the ball 10, each of the elements 12 and 26 is oriented appropriately relative to the other elements to ensure that each magnet will be presented with a pole of the opposing face opposite to its own outwardly facing pole. For this purpose, positive and negative signs may be imprinted on the faces of the wedge-shaped elements, as depicted in FIGS. 2 and 3. The ball 10 is designed so that a child in play or to relieve frustration may hurl the ball 10 against a wall, such as wall 54 shown in FIG. 2. Upon impact, the ball 10 will explode or break apart into its individual elements, although it is possible that certain elements will remain together (such as the pair of magnetically fastened elements shown in FIG. 2). The ball is designed such that the impact necessary to break the ball up into its individual elements is far less than the impact required to actually structurally damage the ball 10. Thus, the breakability of the ball is reversible, since the child may then pick up the individual pieces and reassemble the ball 10, guided by the plus and minus markings on the elements.

If a metal is used as the material from which the ball 10 is formed, it is preferably nonferromagnetic, so that the ball may be assembled in essentially only one configuration. If a ferromagnetic metal is used, a given magnetic may magnetically fasten to any point on an opposing face, except where a magnet with a similar pole (i.e. either positive or negative) is located. Thus, the ball will be partially assemblable in an incorrect fashion. While this may be desired under certain circumstances, it is generally preferable to avoid this complication by utilizing a nonferromagnetic metal.

An advantage of utilizing a shape such as a sphere is that the individual elements are similar or identical to one another, such that the invention may also as a puzzle for the child. The puzzle may be made more difficult by omitting the plus and minus signs. Thus, presented with eight apparently identical wedges, the child must figure out how to assemble the ball by matching the oppositely polarized magnets carried within.

Each of the magnets 30–52 will have an associated magnetic field which extends around the edges thereof, and thus the magnets should be placed far enough apart so that the magnetic fields do not interfere substantially with magnetic fields of other magnets. For instance, if magnet 46 as shown in FIG. 4 is placed too close to magnet 44, the positive field at the upper right edge of magnet 46 may interact with the positive field from the left side of magnet 32 (when magnets 32 and 44 are fastened together), diminishing the force holding elements 20 and 22 in place. Thus, it is advantageous to separate magnets 46 and 44 by an amount which diminishes this interaction sufficiently to allow magnet 44 and magnet 32 to successfully hold elements 22 and 20 together. The proper placement of the magnets may be empirically determined, such as by ensuring that the magnets are far enough apart that accidentally dropping the ball from a height of, for instance, two feet will not cause the ball to break apart.

A countervailing consideration is that the magnets should be placed as close to the vertex of each element as possible, in order to minimize the force necessary to pull the ball apart. If for instance, a child wishes to pull the ball apart by hand, he will grasp the ball at its outer surface, and pull one portion of the ball in one direction and another portion in another direction. This exerts a torque upon the magnets equal to the force of the child's pulling times the radius of the ball (presuming the magnets are adjacent the central vertices). If the magnets are nearer to the outer surface of the ball, then the torque required to pry the magnets apart will be greater, since the moment arm is shortened. Thus, the magnets are preferably positioned relatively close to the vertices, but far enough apart to isolate the magnetic fields, as discussed above. Of course, the force necessary to pull the magnets apart without torque considerations (i.e., pulling the wedges directly apart rather than prying them) will be unaffected by the placement of the magnets relative to the vertices.

The placement of the magnets will have a similar effect upon the strength of the impact necessary to break the ball apart. The magnets may be separated upon impact of the ball 10 with the wall 54 by either shearing forces or by differential torque acting on the individual ball elements as the ball begins to break apart. To the extent that torque is exerted on the individual elements, the same principle regarding placement of the magnets as affecting the impact strength necessary to break the ball apart will apply. Thus, it will be understood that the magnets should be placed as close to the vertices of the elements of the ball as possible, while maintaining the structural stability of the ball 10.

Figure 5:
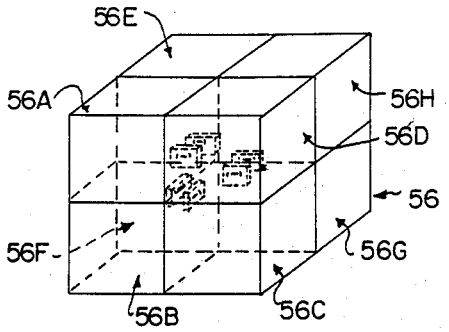
FIG. 5 shows an alternative embodiment of the invention.
Figure 6:
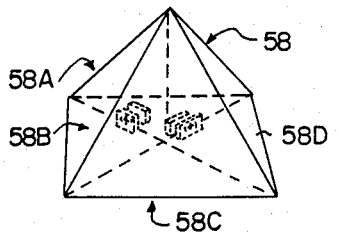
FIG. 6 shows another alternative embodiment of the invention.

Alternative embodiments of the invention are shown in FIGS. 5 and 6, which show a cube 56 and a pyramid 58, respectively. Some of the interior magnets of these embodiments are shown in these figures for purposes of illustration. These embodiments are constructed using the same principles as the embodiments of FIGS. 1–4, and maintain the similarity of the individual elements, so that these embodiments may also be used as puzzles. Thus, cube 56 includes eight identical elements 56A–56H, which include magnets mounted therein, as with the elements 12–26 of the ball 10. Similarly, pyramid 58 includes four identical elements 58A–58D.

Figure 7:
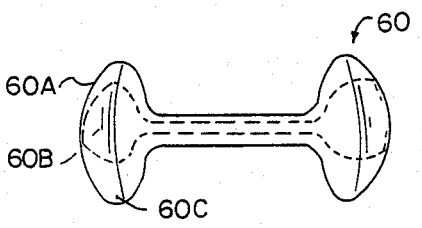
FIG. 7 shows yet another alternative embodiment of the invention.

It will be understood that additional shapes are possible utilizing the principles of the invention. For instance, as shown in FIG. 7, a baby rattle 60 may be used, which is divided into longitudinal sections such as 60A, 60B and 60C. Other configurations, not necessarily including identically shaped elements, are also possible without departing from the spirit and scope of this invention.

I claim:

1. A reversibly breakable toy, comprising:

a plurality of substantially identical wedge-shaped elements, each said element comprising one-eighth of a sphere and having four faces including three flat faces and one arcuate face, said faces being formed of high-impact material and bound together at their edges to form said elements, wherein said elements are configured for assembly into said sphere; and a magnet carried at each said flat face, said magnets having positive and negative polarities configured such that, upon said assembly, said sphere is held in shape by said magnets, where said material is chosen such that a first force necessary to separate said elements from one another by impact against a surface is less than a second force necessary to cause structural damage to said elements;

wherein, upon assembly of said sphere, each said flat face opposes one other said flat, and wherein:

each said element includes a vertex defined by an intersection of said three flat faces; and each said magnet is mounted at a distance from one said vertex of a given said flat face, said distance being minimized by locating said magnets as close as possible to said vertices without substantially interfering with magnetic fields from magnets mounted on other said faces which are not opposed to said given flat face.

2. The toy of claim 1, wherein said material forming said faces has a thickness sufficient to provide structural strength such that said second force is greater than said first force, but is thin enough such that magnetic fields of said magnets interact with one another for maintaining said elements in a spherical configuration until impacted; and such that said faces define an interior and an exterior for each said element, wherein said magnets are carried on said interiors of said elements.

3. The toy of claim 1, wherein plus and minus signs are imprinted on said flat faces for indicating said positive and negative polarities, respectively.

4. A reversibly disassemblable toy, comprising:

a plurality of elements each said element comprising a portion of a given geometrical shape and having a plurality of flat faces, said faces being formed of high-impact material and bound together at edges thereof to form said elements, wherein said elements are configured for assembly into said geometrical shape; and a magnet carried at each said flat face, said magnets having positive and negative polarities configured such that, upon said assembly, said shape is maintained by said magnets, where said material is chosen such that a first force necessary to separate said elements from one another by impact with a surface is less than a second force necessary to cause structural damage to said elements;

wherein, upon assembly of said geometrical shape, each said flat face opposes one other said flat face, and wherein:

each said element includes a vertex defined by an intersection of said plurality of flat faces; and each said magnet is mounted at a distance from one said vertex of a given said flat face, said distance being minimized by locating said magnets as close as possible to said vertices without substantially interfering with magnetic fields from magnets mounted on other said faces which are not opposed to said given flat face.

5. The toy of claim 4, wherein:

said material forming said faces has a thickness sufficient to provide structural strength such that said second force is greater than said first force, but is thin enough such that magnetic fields of said magnets interact with one another for maintaining said elements in said geometrical shape;

such that said faces define an interior and an exterior for each said element, wherein said magnets are carried on said interiors of said elements.

6. The toy of claim 5, wherein said shape is a cube.

7. The toy of claim 5, wherein said shape is a pyramid.

8. The toy of claim 6, wherein shape is a dumbbell shape.

* * * * *